US006926551B1

(12) United States Patent
Schulz et al.

(10) Patent No.: US 6,926,551 B1
(45) Date of Patent: Aug. 9, 2005

(54) PLUGGABLE TRANSCEIVER LATCHING MECHANISM

(75) Inventors: Klaus Schulz, Berlin (DE); Schelto Van Doorn, San Jose, CA (US)

(73) Assignee: Infineon Technologies AG, Munich (DE)

( * ) Notice: Subject to any disclaimer, the term of this patent is extended or adjusted under 35 U.S.C. 154(b) by 0 days.

(21) Appl. No.: 09/672,571

(22) Filed: Sep. 27, 2000

Related U.S. Application Data

(60) Provisional application No. 60/175,610, filed on Jan. 11, 2000.

(51) Int. Cl.[7] ..... H01R 13/62
(52) U.S. Cl. ..... 439/357; 439/310; 439/607
(58) Field of Search ..... 439/352, 357, 439/358, 248, 310, 353, 607

(56) References Cited

U.S. PATENT DOCUMENTS

| | | | | |
|---|---|---|---|---|
| 5,864,468 | A | 1/1999 | Poplawski et al. | 361/753 |
| 5,879,173 | A | 3/1999 | Poplawski et al. | 439/138 |
| 5,980,324 | A | 11/1999 | Berg et al. | 439/630 |
| 6,000,856 | A | 12/1999 | Yunker | 385/75 |
| 6,022,151 | A | 2/2000 | Meyer-Guldner et al. | 385/92 |
| 6,095,862 | A * | 8/2000 | Doye et al. | 439/607 |
| 6,135,793 | A * | 10/2000 | Babineau | 439/92 |
| 6,149,465 | A * | 11/2000 | Berg et al. | 439/630 |
| 6,575,790 | B2 | 6/2003 | Stockhaus et al. | |
| 2001/0016442 | A1 | 8/2001 | Stockhaus et al. | |

FOREIGN PATENT DOCUMENTS

| | | |
|---|---|---|
| DE | 197 49 910 A1 | 5/1999 |
| DE | 198 43 627 C2 | 4/2000 |
| EP | 0 942 497 A2 | 9/1999 |
| JP | 10-321306 | 4/1998 |
| WO | WO 97/47058 | 12/1997 |
| WO | WO 00/17967 | 3/2000 |

* cited by examiner

*Primary Examiner*—Renne Luebke
(74) *Attorney, Agent, or Firm*—Fish & Richardson P.C.

(57) ABSTRACT

The invention features novel systems and methods for latching a pluggable transceiver to and unlatching the pluggable transceiver from a cage. In one aspect, a pluggable transceiver includes a housing and a cam. The housing has a front end configured to couple to a transmission cable and a back end configured to be inserted into a cage. The cam is disposed on an exposed outer surface of the transceiver housing and is configured to displace a cage latch and engage a cage slot upon insertion of the transceiver housing into the cage. In another aspect, a cage includes a housing and a latch. The housing has a front end for receiving a pluggable transceiver and defines a slot for engaging a transceiver cam. The latch is disposed at the front end of the cage housing. The latch also is configured to bend outwardly from an original position in response to a force applied by the transceiver cam as the transceiver is being inserted into the cage and to resiliently return to the original position upon engagement of the transceiver cam with the slot defined in the front end of the cage housing. A data coupling system comprising the above-defined pluggable transceiver and cage also is described.

13 Claims, 5 Drawing Sheets

PLUGGABLE TRANSCEIVER LATCHING MECHANISM

CROSS-REFERENCE TO RELATED APPLICATIONS

This application claims the benefit of U.S. Provisional Application No. 60/175,610, which was filed Jan. 11, 2000, by Schelto van Doorn and Klaus Schulz, and is entitled "Latch Mechanism."

TECHNICAL FIELD

This invention relates to pluggable transceivers and cages and to systems and methods of latching a pluggable transceiver to a cage.

BACKGROUND

Transmission cables may be used to transmit data between workstations, mainframes and other computers, as well as provide data connections to mass storage devices and other peripheral devices. Data may be transferred using a variety of transmission cable technologies, including multimode optical fiber cables, single mode optical fiber cables, and copper cables (e.g., twinax and coax copper cables). Standard pluggable transceiver modules have been developed to transition between different transfer media and the electronic components inside a computer or peripheral device. A pluggable transceiver module produces a standardized output in accordance with prescribed protocols, regardless of the medium (e.g., optical fiber or copper) through which the data is transmitted or received. A transceiver module typically plugs into a cage that extends out of the rear panel of a computer or peripheral device. The cage connects the transceiver module to a motherboard or circuit card in the computer or peripheral device.

SUMMARY

The invention features novel systems and methods for latching a pluggable transceiver to and unlatching the pluggable transceiver from a cage.

In one aspect of the invention, a pluggable transceiver comprises a housing and a cam. The housing has a front end configured to couple to a transmission cable and a back end configured to be inserted into a cage. The cam is disposed on an exposed outer surface of the transceiver housing and is configured to displace a cage latch and engage a cage slot upon insertion of the transceiver housing into the cage.

Embodiments in accordance with this aspect of the invention may include one or more of the following features.

The cam preferably has a chamfered surface exposed for contact with the cage latch as the transceiver is being inserted into the cage. The chamfered surface of the cam may be rectangular or it may taper from the front end to the back end of the transceiver housing.

The pluggable transceiver may include a release mechanism disposed on a surface of the transceiver housing and configured to disengage the cam from the cage slot. The release mechanism may include a release block configured to slide into engagement with the cage latch to disengage the cam from the cage slot. The release block preferably comprises a chamfered surface exposed for contact with the cage latch.

In another aspect of the invention, a cage comprises a housing and a latch. The housing has a front end for receiving a pluggable transceiver and defines a slot for engaging a transceiver cam. The latch is disposed at the front end of the cage housing. The latch also is configured to bend outwardly from an original position in response to a force applied by the transceiver cam as the transceiver is being inserted into the cage and to resiliently return to the original position upon engagement of the transceiver cam with the slot defined in the front end of the cage housing.

Embodiments in accordance with this aspect of the invention may include one or more of the following features.

The latch preferably includes a front end having an inner surface that flares outwardly away from an interior region of the cage housing. The cage latch may be formed integrally with the cage housing. The cage housing preferably is configured to shield against electromagnetic interference.

The cage may include an ejection mechanism configured to engage and apply an ejection force against the pluggable transceiver when disposed within the cage housing. The cage also may include a circuit card connector disposed in a back end of the cage housing and configured to couple the pluggable transceiver to a circuit card. The cage housing preferably is configured to engage an opening in an electromagnetic enclosure.

In another aspect, the invention features a data coupling system comprising the above-defined pluggable transceiver and cage.

Among the advantages of the invention are the following.

The invention provides an elegant and cost-effective way to securely latch a pluggable transceiver to a cage. In addition, by incorporating the latch into the cage, the invention avoids exposure of the latching mechanism to edges and other surfaces on which the latch may catch during normal use conditions. As a result, the invention reduces the likelihood that the latch will become deformed or broken, improving the durability and expected use-life of the latch.

Other features and advantages of the invention will become apparent from the following description, including the drawings and the claims.

DETAILED DESCRIPTION

In the following description, like reference numbers are used to identify like elements. Furthermore, the drawings are intended to illustrate major features of exemplary embodiments in a diagrammatic manner. The drawings are not intended to depict every feature of actual embodiments or relative dimensions of the depicted elements, and are not drawn to scale.

Figure 1A:
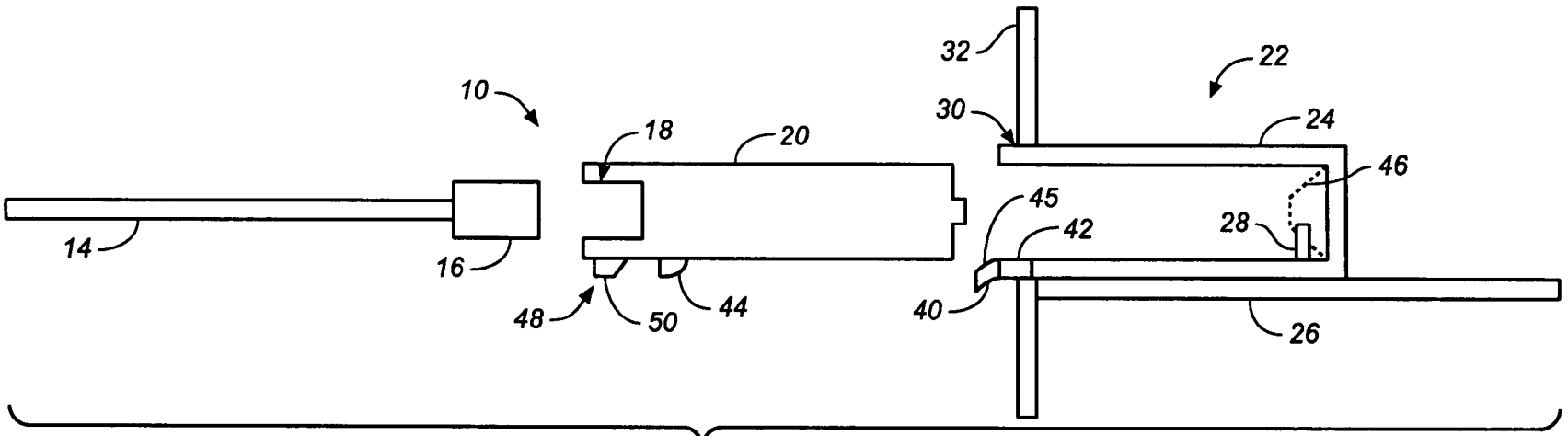
FIG. 1A. is a diagrammatic cross-sectional side view of a transceiver module, a cage that extends out of the rear panel of an electronic equipment enclosure, and a transmission cable.
Figure 1B:
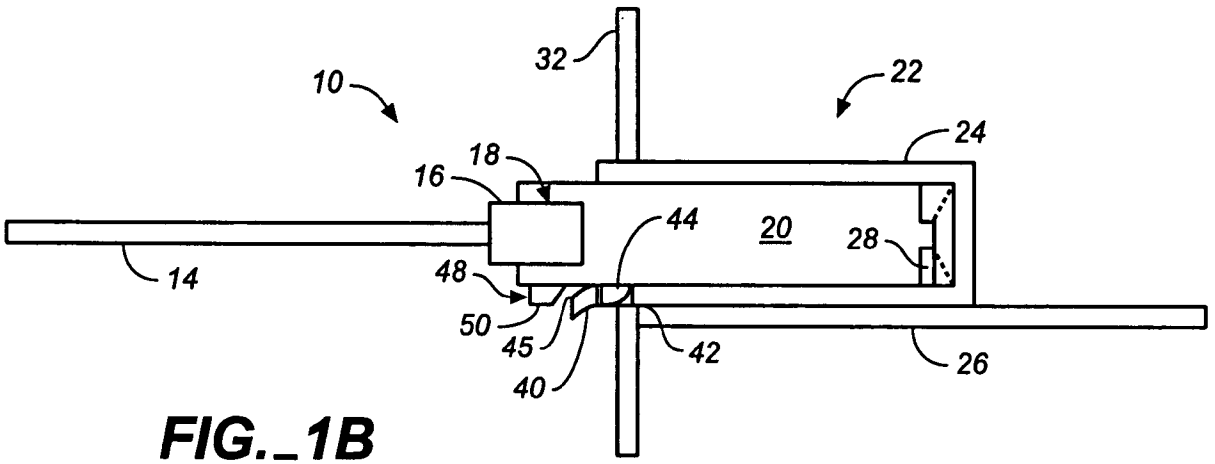
FIG. 1B is a diagrammatic cross-sectional side view of the transmission cable, transceiver module and cage of FIG. 1A connected together with the release mechanism in a first position.

Referring to FIGS. 1A and 1B, in one embodiment, a data coupling system 10 includes a transmission cable 14 and an associated cable connector 16. Cable connector 16 is configured to plug into a mating connector 18 of a pluggable transceiver module 20 that, in turn, is configured to plug into a receptacle assembly 22. Receptacle assembly 22 includes a cage 24 mounted on a circuit card (or motherboard) 26, and a circuit card (or host interface) connector 28 that electrically connects transceiver module 20 to circuit card 26. Cage 24 extends through a mounting panel opening 30 in a rear panel 32 of an electromagnetically shielded electronic equipment enclosure. Transceiver module 20 is configured to transition between circuit card 26 and the transfer medium of transmission cable 14. As shown in FIG. 1B, in operation, transceiver module 20 plugs into cage 24 and cable connector 16 plugs into transceiver module connector 18.

As explained in detail below, cage 24 includes a latch 40 and a slot 42 that engages a mating cam 44 on a bottom surface of transceiver module 20. Latch 40 has a front end with an inner surface 45 that flares outwardly away from the interior of cage 24. As transceiver module 20 is being inserted into cage 24, cam 44 engages the flared inner surface 45 of latch 40 and displaces the front end of latch 40 outwardly. As soon as the rear end of cam 44 clears the rear edge of slot 42, cam 44 slides into slot 42 and the front end of latch 40 resiliently returns to its original position to hold transceiver module in place. Incorporating latch 40 into cage 24 avoids exposure of the latching mechanism to edges and other surfaces on which the latch may catch during normal use conditions. This feature reduces the likelihood that the latch will become deformed or broken, thereby improving the durability and expected use-life of the latch. Cage 24 also includes an ejection mechanism 46 that is configured to apply an ejection force against the back end of transceiver module 20 when transceiver module 20 is plugged into cage 24.

Figure 1C:
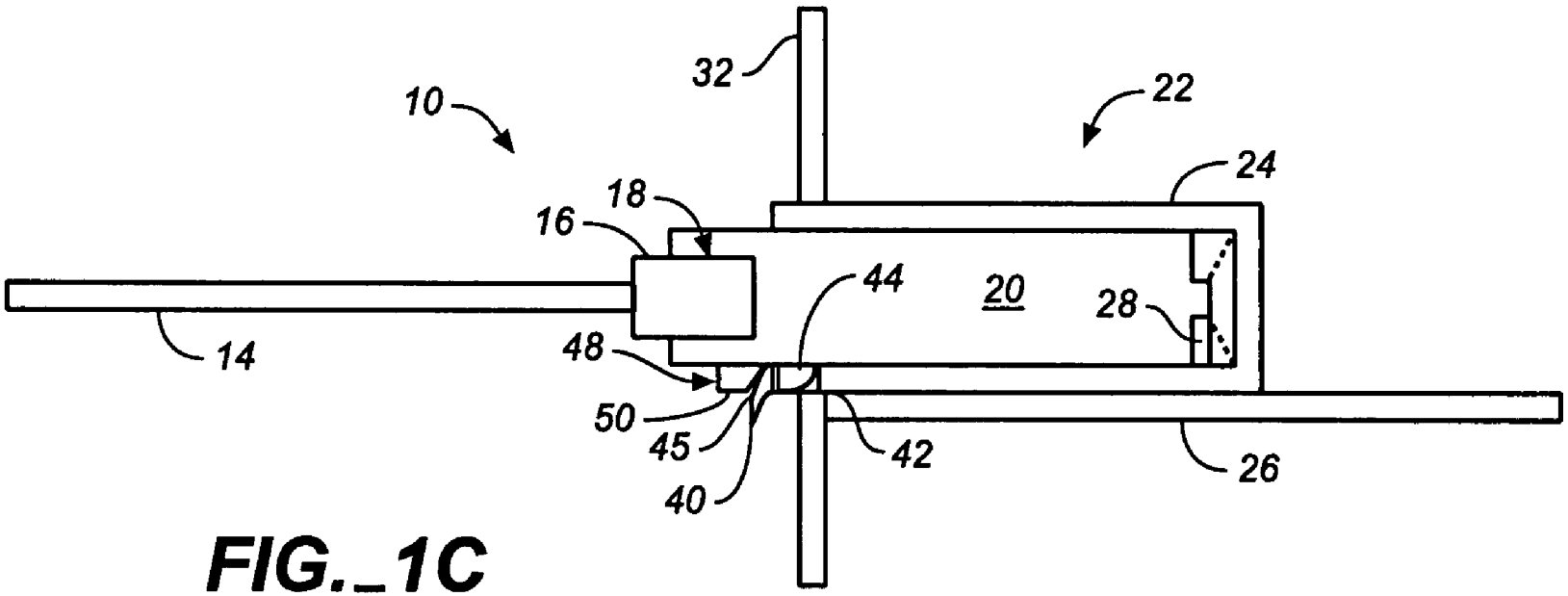
FIG. 1C is a diagrammatic cross-sectional side view of the transmission cable, transceiver module and cage of FIG. 1A with the release mechanism in a second position.

Transceiver module 20 may be released from cage 24 by displacing the front end latch 40 until the rear edge of cam 44 clears the rear edge of slot 42. In some embodiments, the front end of latch 40 may be displaced using a tool, such as a screwdriver. Other transceiver module embodiments may include a release mechanism 48 formed from a release block 50, which is slidable toward and away from the back end of transceiver module 20 within a longitudinal slot 51 defined in the bottom surface of transceiver module 20, as shown in FIGS. 1B and 1C. In operation a user may press release block 50 toward cage 24, from a first position shown in FIG. 1B into a second position shown in FIG. 1C, until latch 40 has been displaced outwardly by an amount sufficient for the rear edge of cam 44 to clear the rear edge of slot 42, at which point the ejection force applied by ejection mechanism 46 forces transceiver module 20 out of cage 24.

Figure 2:
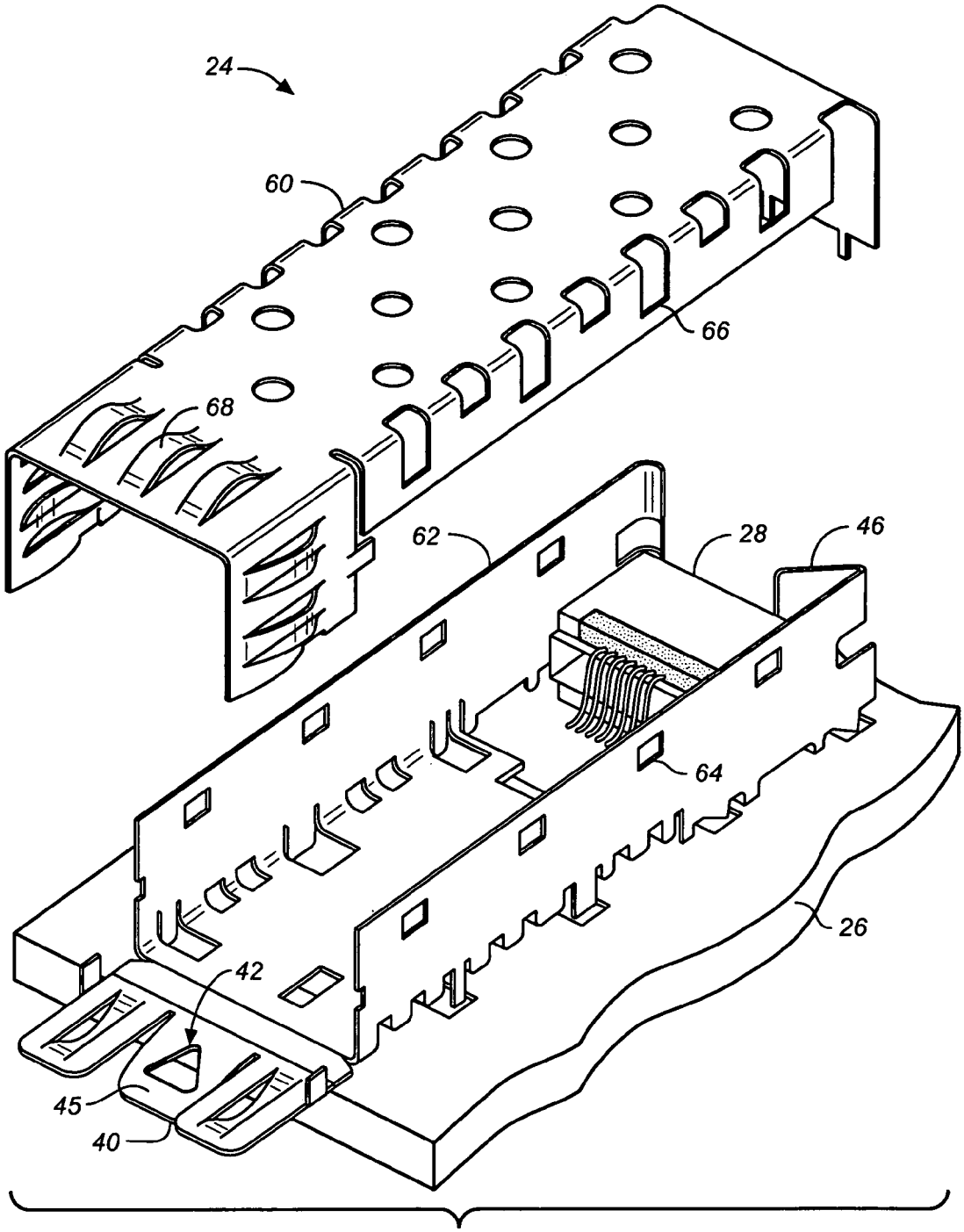
FIG. 2 is a diagrammatic exploded view of the cage of FIGS. 1A and 1B.
Figure 3A:
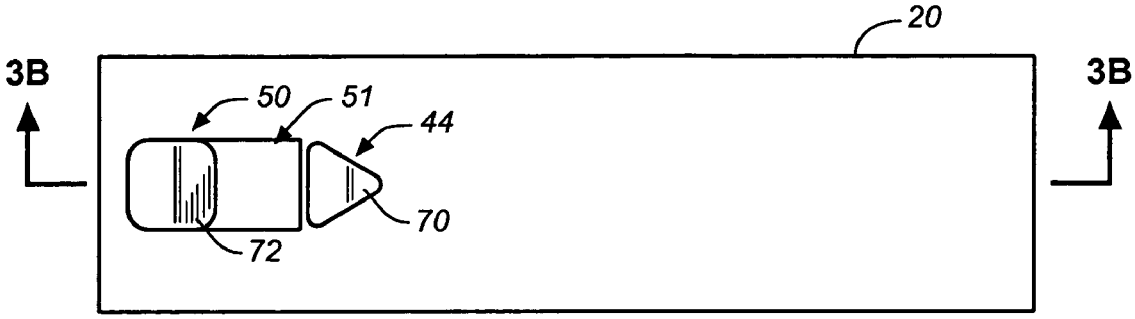
FIG. 3A is a diagrammatic bottom view of the transceiver of FIGS. 1A and 1B with the release mechanism in a first position.
Figure 3B:
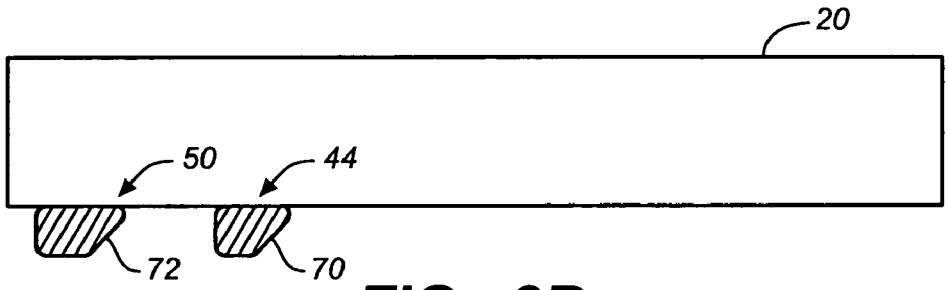
FIG. 3B is a diagrammatic cross-sectional view of the transceiver of FIGS. 1A and 1B, taken along the line 3B–#B in FIG. 3A, with the release mechanism in a first position.
Figure 3C:
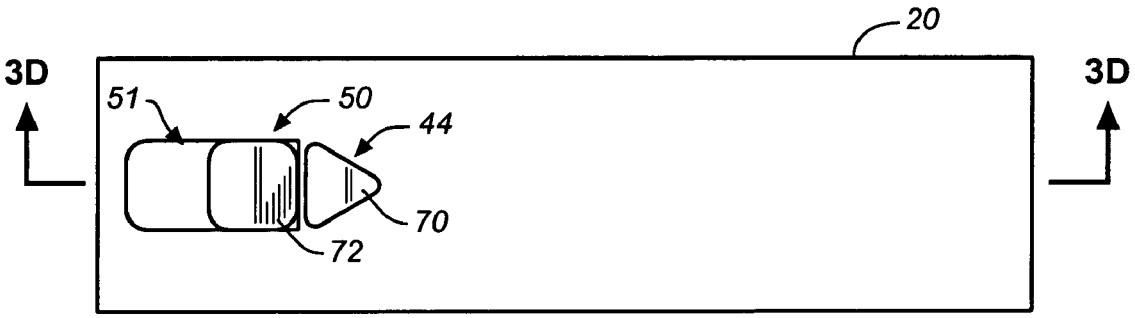
FIG. 3C is a diagrammatic exploded view of the transceiver of FIGS. 1A and 1B with the release mechanism in a second position.
Figure 3D:
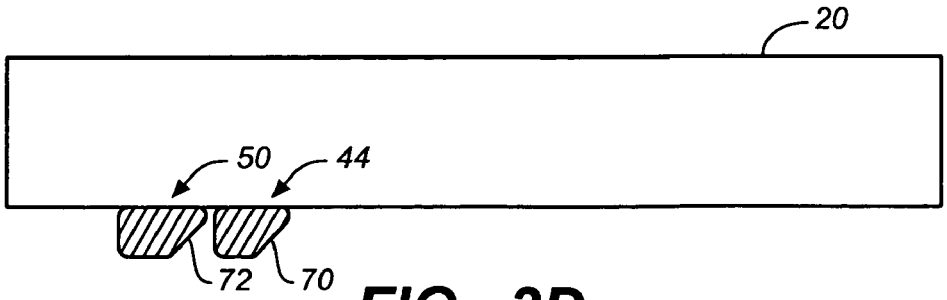
FIG. 3D is a diagrammatic cross-sectional view of the transceiver of FIGS. 1A and 1B, taken along the line 3C—3C in FIG. 3C, with the release mechanism in a second position.

Referring to FIG. 2, in one embodiment, cage 24 is constructed out of metallic sheets that are folded and stamped to form a top half 60 and a bottom half 62. Bottom half 62 of cage 24 includes a series of lugs 64 that latch onto a respective series of corresponding slots 66 defined in top half 60 of cage 24. Ejection mechanism 46 is formed integrally with bottom half 60 by bending the walls at the back end of the bottom half 62 of cage 24 toward the front end of cage 24. Top half 60 of cage 24 also includes a series of integral resilient springs 68 that are configured to engage an opening in a rear panel of an electromagnetically shielded electronic equipment enclosure. Cage 24 preferably is formed from material sheets that are designed to shield against electromagnetic interference, such as stainless steel or other conductive material.

Figure 4A:
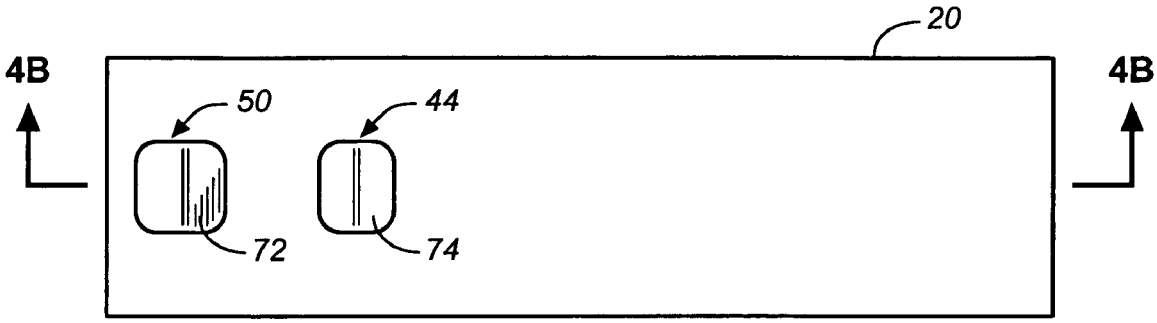
FIG. 4A is a diagrammatic bottom view of an alternative transceiver.
Figure 4B:
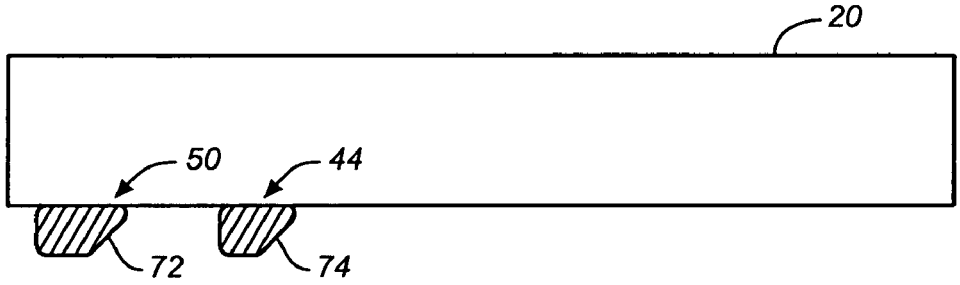
FIG. 4B is a diagrammatic cross-sectional view of the transceiver of FIG. 4A taken along the line 4B—4B.

Referring to FIGS. 3A–3D, in on transceiver embodiment, cam 44 includes a chamfered surface 70 that tapers from the front end to the back end of transceiver module 20. Tapering chamfered surface 70 reduces the area of contact between cam 44 and latch 40 and, thereby reduces the force needed to insert transceiver module 40 into cage 24. Release block 50 shown in a first position in FIGS. 3A–3B and in a second position in FIGS. 3C–3D, also has a chamfered surface 72 for engaging the flared front end 45 of latch 40. As shown in FIGS. 4A and 4B, in other embodiments, the chamfered surface of cam 44 may have a non-tapered shape. For example, in one embodiment, the shape of cage slot 42 is selected to match the profile of cam 44. Thus, latch 40 would have a triangular slot for engaging the transceiver module embodiment of FIGS. 3A–3D, and latch 40 would have a rectangular slot for engaging the transceiver module embodiment of FIGS. 4A and 4B. The physical dimensions of cam 44 are selected based at least in part upon the material composition of cam 44 and the desired retention force between cam 44 and latch 40 when transceiver module 20 is latched inside cage 24 (e.g., approximately 60–100 Newtons).

Data coupling system 10 may incorporate a variety of different transfer media and media connectors. For example, transmission cable 14 may be an optical fiber cable (e.g., a single mode or a multimode optical fiber cable) or an electrical (copper) cable (e.g., a twinax or a coax copper cable). Cable connector 16 and transceiver connector 18 may conform to any one of a variety of optical and copper interface standards, including HSSDC2-type, RJ-type, SC-type, SG-type, ST-type and LC-type connectors, ribbon cable connectors, and twinax and coaxial cable connectors (e.g., SMA connectors). Cage 28 also may conform to a variety of host interface standards, including the MIA (Media Interface Adapter) standard and the recently proposed MSA standard.

Other embodiments are within the scope of the claims.

What is claimed is:

1. A pluggable transceiver comprising:

a housing having a front end configured to couple to a transmission cable and a back end configured to be inserted into a cage;

a cam disposed on an exposed bottom outer surface of the housing and configured to engage a cage latch within the cage; and a release mechanism attached to the bottom surface of the housing between the cam and the front end of the housing and selectively movable between at least a first position and a second position, where the release mechanism is in the first position when the transceiver is engaged within the cage and is moved along the bottom surface from the first position toward the cam and into the second position to disengage the transceiver from the cage.

2. The pluggable transceiver of claim 1, wherein the cam has a chamfered surface exposed for contact with the cage latch as the transceiver is being inserted into the cage.

3. The pluggable transceiver of claim 2, wherein the chamfered surface of the cam is rectangular.

4. The pluggable transceiver of claim 2, wherein the chamfered surface of the cam tapers from the front end to the back end of the transceiver housing.

5. The pluggable transceiver of claim 1, wherein the release mechanism comprises a release block configured to slide into the second position to disengage the transceiver from the cage.

6. The pluggable transceiver of claim 5, wherein the release block comprises a chamfered surface exposed for contact with the cage latch.

7. A data coupling system, comprising:

a pluggable transceiver comprising a transceiver housing having a front end configured to couple to a transmission cable, the transceiver housing including a transceiver cam disposed on an exposed outer surface of the transceiver housing and a release mechanism disposed on the exposed outer surface of the transceiver housing between the front end and the transceiver cam and configured to disengage the transceiver cam from a cage slot; and a cage comprising a cage housing having a front end for receiving the pluggable transceiver and defining a cage slot for engaging the transceiver cam, and a latch disposed at the front end of the cage housing, the latch including a front end having an inner surface that flares outwardly away from an interior region of the cage housing;

wherein the transceiver cam is configured to displace the latch and engage the cage slot upon insertion of the transceiver housing into the cage, and the latch is configured to bend outwardly from an original position in response to a force applied by the transceiver cam as the transceiver is being inserted into the cage and to resiliently return to the original position upon engagement of the transceiver cam and the slot defined in the front end of the cage housing.

8. The data coupling system of claim 7, wherein the transceiver cam has a chamfered surface exposed for contact with the latch as the transceiver is being inserted into the cage.

9. The data coupling system of claim 7, wherein the release mechanism comprises a release block configured to slide into engagement with the latch to disengage the transceiver cam from the cage slot.

10. The data coupling system of claim 9, wherein the release block comprises a chamfered surface exposed for contact with the latch.

11. The data coupling system of claim 7, wherein the cage further comprises an ejection mechanism configured to engage and apply an ejection force against the pluggable transceiver when disposed within the cage housing.

12. The data coupling system of claim 7, wherein the release mechanism is selectively movable between at least a first position and a second position, where the release mechanism is in the first position when the transceiver is engaged within the cage and is moved along the bottom surface from the first position toward the transceiver cam and into the second position to disengage the transceiver from the cage.

13. A pluggable transceiver comprising:

a substantially rectangular shaped housing having a front end configured to couple to a transmission cable and a back end;

a cam disposed on an exposed bottom outer surface of the housing, the bottom surface substantially perpendicular to the front end and the back end;

a longitudinal slot defined in the bottom surface of the housing; and a release block attached to the bottom surface of the housing between the front end and the cam, and slid able within the longitudinal slot between a first position and a second position, where the release block is slid within the longitudinal slot from the first position toward the cam and into the second position to disengage the cam from engagement with a latch.

* * * * *